US008225963B2

(12) United States Patent
Mehaffy et al.

(10) Patent No.: US 8,225,963 B2
(45) Date of Patent: Jul. 24, 2012

(54) INTEGRATED LOW APPLICATION TEMPERATURE HOT MELT ADHESIVE PROCESSING SYSTEM

(75) Inventors: Justin A. Mehaffy, Hampton, NJ (US); David Duckworth, Blackburn (GB); John Rye, Mason, OH (US)

(73) Assignee: Henkel AG & Co. KGaA, Duesseldorf (DE)

( * ) Notice: Subject to any disclaimer, the term of this patent is extended or adjusted under 35 U.S.C. 154(b) by 619 days.

(21) Appl. No.: 11/244,808

(22) Filed: Oct. 6, 2005

(65) Prior Publication Data

US 2007/0080157 A1 Apr. 12, 2007

(51) Int. Cl.
*B67D 7/80* (2010.01)

(52) U.S. Cl. ..... 222/146.2; 222/64; 222/146.5; 219/421

(58) Field of Classification Search ..... 222/146.5, 222/146.2, 146.1, 56, 64; 219/392, 421
See application file for complete search history.

(56) References Cited

U.S. PATENT DOCUMENTS

| | | | | |
|---|---|---|---|---|
| 3,408,008 | A * | 10/1968 | Cocks | 239/135 |
| 3,531,023 | A * | 9/1970 | Mercer | 222/146.5 |
| 3,773,069 | A * | 11/1973 | Rebentisch | 137/341 |
| 4,485,941 | A * | 12/1984 | Frates et al. | 222/146.5 |
| 4,545,504 | A * | 10/1985 | Fabel et al. | 222/55 |
| 4,598,842 | A | 7/1986 | Sticher et al. | |
| 5,735,588 | A * | 4/1998 | Dittman et al. | 312/330.1 |
| 5,814,790 | A * | 9/1998 | Bondeson et al. | 219/421 |
| 5,919,384 | A | 7/1999 | Reifenberger et al. | |
| 6,433,315 | B2 | 8/2002 | Reifenberger et al. | |
| 6,499,629 | B1 | 12/2002 | Colangelo et al. | |
| 6,883,684 | B2 * | 4/2005 | Jeter et al. | 222/146.2 |
| 2003/0080156 | A1 * | 5/2003 | Jeter et al. | 222/146.5 |
| 2005/0016985 | A1 * | 1/2005 | Haas et al. | 219/438 |
| 2005/0176872 | A1 * | 8/2005 | Martin et al. | 524/515 |
| 2005/0274740 | A1 | 12/2005 | Duckworth et al. | |

FOREIGN PATENT DOCUMENTS

| | | | |
|---|---|---|---|
| WO | 0179111 | A1 | 10/2001 |
| WO | 2005123268 | A2 | 12/2005 |

* cited by examiner

*Primary Examiner* — Frederick C. Nicolas
(74) *Attorney, Agent, or Firm* — Sun Hee Lehmann

(57) ABSTRACT

An autofeeding low application temperature hot melt application system comprises a hot melt tank, a compact integrated auto feed, and operates at temperatures of not more than 260° F.

10 Claims, 1 Drawing Sheet

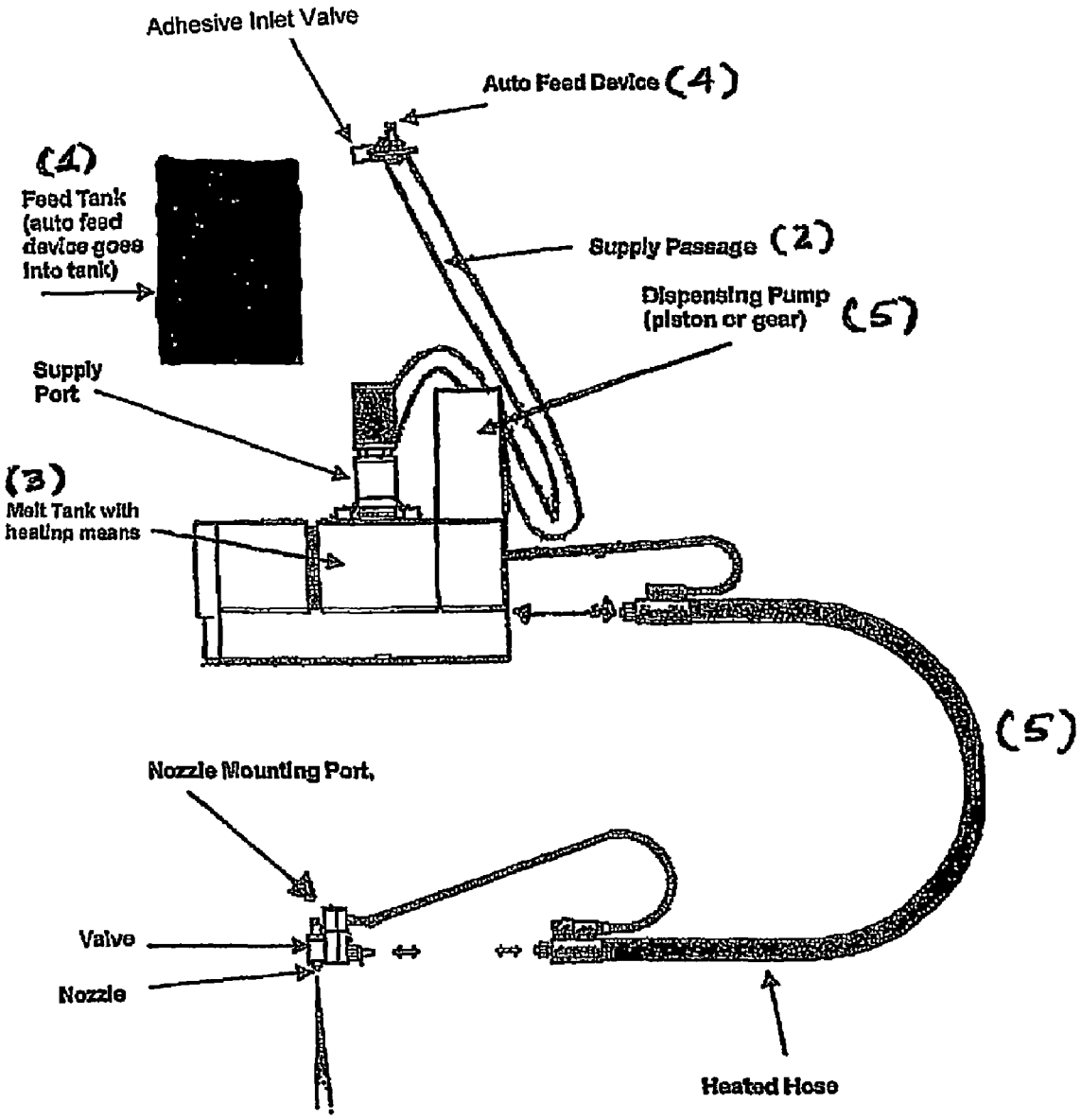
Adhesive Inlet Valve
Auto Feed Device (4)
(4)
Feed Tank (auto feed device goes into tank)
Supply Passage (2)
Dispensing Pump (piston or gear) (5)
Supply Port
(3)
Melt Tank with heating means
(5)
Nozzle Mounting Port,
Valve
Nozzle
Heated Hose

INTEGRATED LOW APPLICATION TEMPERATURE HOT MELT ADHESIVE PROCESSING SYSTEM

FIELD OF THE INVENTION

The invention relates to hot melt adhesive dispensing technology, more specifically to a system for melting and dispensing low application temperature hot melt adhesives.

BACKGROUND OF THE INVENTION

Equipment currently available to the adhesive industry for use in processing hot melt adhesives is designed and manufactured to operate at high pressures and at high temperatures, e.g., up to 450° F. These units are designed to heat to a molten state hot melt adhesives that are then transported for application to a substrate surface. Such adhesives are conventionally applied at high temperatures, i.e., temperatures greater than 300° F., up to about 350° F. or higher.

Conventional hot melt adhesives require temperatures greater than 300° F. in order to ensure complete melting of all the components and also to achieve a satisfactory application viscosity. Even when processing conventional hot melt adhesives using conventional equipment, problems such as adhesive stagnation and air pocketing occur. This contributes to char formation and related overheating problems which adversely affect dispensing performance. Frequent down time, trouble shooting and maintenance, as well as part replacement is required and is costly. The need for high temperature also increases operator's risk with respect to both burns and inhalation of residual volatiles. In addition, high temperatures require more energy, placing greater demands on the manufacturing facility.

Recent innovations in adhesive chemistry have resulted in adhesives that can be applied at lower temperatures, i.e., temperatures less than 300° F. Processing and dispensing of low application temperature adhesives require certain considerations not encountered when processing conventional hot melt adhesives.

First, lowering the application temperature is known to increase the viscosity of conventional hot melt adhesives resulting in greater wear and tear to processing equipment. This adhesive is formulated to achieve the balance of low viscosity and performance required to maintain package integrity. Second, low application temperature hot melt adhesives are formulated with tackifiers which are typically unstable and known to accelerate wear to processing equipment. Third, due to their low processing and melt point temperature requirements, the adhesive would be expected to block if conveyed through an auto feed unit. Fourth, the dispensing tube on the autofeed unit would be expected to be longer in length than those used to process conventional hot melt adhesives in conventional processing equipment due to both conductive and convective heating and condensation on high temperature volatiles.

There exists a need in the art for an integrated system that can be used to process low application temperature hot melt adhesives for, e.g., packaging operations such as for forming and/or sealing and closing operations for cartons, cases or trays. The current invention fulfills this need.

SUMMARY OF THE INVENTION

The invention provides a system wherein hot melt adhesives, specifically formulated for application at temperatures of 290° F. or less, more typically temperatures of 160° F. to 260° F., even more typically 190° F. to 250° F., are transported, melted and dispensed.

Compared to prior art hot melt processing equipment, use of the integrated system of the invention surprisingly extends the service life of the equipment, its electrical components and, the pot life of the adhesive.

The invention provides an integrated system for the processing of low application temperature hot melt adhesives comprising a low application temperature hot melt adhesive, a melt tank having a interior cavity adapted to receive said adhesive, and an auto feed device integrally connected to the melt tank, said system comprising heating elements that are controlled or programmed to reach a maximum operating temperature of 250° F.

In one embodiment of the invention, the system comprises a feed tank or reservoir for maintaining a supply of low application temperature hot melt adhesive in its solid form, a supply passage connected to said feed tank for supplying adhesive to the interior cavity of a melt tank, a supply port or inlet in communication with the interior cavity of the melt tank and connected to the supply passage, a melt tank comprising heating elements, a nozzle mounting port including a dispensing orifice which is opened and closed by a valve, and a nozzle for dispensing molten hot melt adhesive from the dispensing orifice.

Another embodiment of the invention is directed to a packaging method using the system of the invention.

BRIEF DESCRIPTION OF THE DRAWING FIGURE

FIG. 1 is a schematic diagram of a hot melt dispersing system.

DETAILED DESCRIPTION OF THE INVENTION

The invention provides an integrated system for the processing of hot melt adhesives. By using a low application temperature hot melt adhesive, problems encountered in the prior art (e.g., life of valves, charring, etc.) is reduced or eliminated and contemplated problems arising from using low application temperature hot melt adhesives are unexpectedly not encountered.

The invention provides an integrated system for processing and dispensing low application temperature hot melt adhesives. The system is useful for processing and dispensing adhesives formulated for application at temperatures of 290° F. or less, more typically temperatures of 160° F. to 260° F., even more typically 190° F. to 250° F. Such adhesives can be transported, processed and dispensed for use in a safer, more economical way.

The system comprises a low application temperature hot melt adhesive product, a melt tank with integrated level control and a high efficiency auto dispensing unit.

The adhesive product used in the system of the invention is not particularly limited, as long as the adhesive can be processed for application at low temperatures. As used herein, low temperature refers to temperatures of from 260° F. or less, more typically temperatures of 160° F. to 260° F., even more typically 190° F. to 250° F.

Virtually any low application temperature hot melt adhesive may be used is the practice of the invention. Base polymers suitable for use in formulating low application hot melt adhesives include amorphous polyolefins, ethylene-containing polymers and rubbery block copolymers, as well as blends thereof. Hot melt adhesive compositions based on ethylene/vinyl acetate copolymer, isotactic or atactic polypropylene, styrene-butadiene, styrene-isoprene, or styrene-ethylene-butylene A-B-A or A-B-A-B block copolymers or mixtures thereof may be used. Blends of any of the above base materials, such as blends of ethylene n-butyl acrylate and ethylene vinyl acetate and ethylene vinyl acetate and atactic polypropylene may also be used to prepare hot melt adhesive compositions. In all cases, the adhesives may be formulated with tackifying resins, oils plasticizers, waxes and/or other conventional additives including stabilizers, anti-oxidants, pigments and the like.

With reference to FIG. 1, when the system is in operation, the low application temperature hot melt adhesive, in solid form, is continuously feed, conveyed or dispensed from a solid material staging area or depot (1), also referred to herein as a feed tank, drum or bin, via a supply passage or conduit (2) such as a tube, hose or the like, to the melt tank (3).

Conveyance into the melt tank is controlled by an auto feed (4) or automatic dispending device that is integrally connected to the melt tank. The auto feed device automatically fills the melt tank in response to a level detector present in the melt tank.

In the melt tank, heating elements heat the adhesive contained therein to a predetermined set temperature. Use of a low application temperature hot melt adhesive and temperature controls of the invention enable the positioning of the feed tank closer to the melt tank.

An integrated control panel is used to control the adhesive level and to prevent the temperature from exceeding a prescribed temperature. Typically, the control will be set to prevent temperatures higher than 290° F. In one embodiment, the control will be set to prevent the temperature for going above about 250° F. In another embodiment, the control will be set to prevent the temperature for going above about 160° F.

An audible alarm will preferable be present to indicate when the solid hot melt bin is empty, when the melt tank is empty and when the temperature is outside of the desired or predetermined limit.

The system will also comprise a dispensing port, a pump, and a transport hose (5) for transporting molten to the site of dispensing. By using the low application temperature hot melt adhesive system of the invention, the molten hot melt can unexpectedly be transported up to 10 m, more typically up to 40 m, from the melt tank to the site of application.

The system comprises and low application temperature hot melt adhesive, a feed tank, an auto feed device for receiving solid adhesive and a melt tank. The auto feed is integrally connected to a heat tank.

A supply connector or passage conveys solid adhesive from a supply drum to the auto feed device.

In the system of the invention, a low application temperature hot melt adhesive in solid form is automatically fed by way of an automatic dispensing device (auto feed) into a heated melt tank, where the adhesive melts and is maintained at a predetermined temperature. Melted adhesive is maintained at a predetermined level by level detectors present in the melt tank. Molten adhesive is then pumped from the melt tank through a nozzle mounting port, bore or outlet which includes a dispensing orifice which is opened and closed by a valve stem, to a nozzle for dispensing of the molten hot melt adhesive.

The shape of the unit and/or parts making up the unit is not particularly limiting. The autofeed and/or melt tank may comprise a single wall (e.g., is cylindrical in shape), or a plurality of walls (e.g., is square, rectangular, or the like).

The auto feed is integrally linked to the melt tank and these system components may be manufactured of the same or different material. Solid adhesive, in the form of pellets or other such conventional form, is introduced into the feed tank via an adhesive inlet valve, e.g. by blowing or other conventional means. Means for removing air accompanying the introduction of the solid adhesive into the auto feed may be used. If desired baffles or other such means may be present in the auto-feed which function to direct solid adhesive toward the melt tank and/or deflect heat.

The melting tank comprises heating means, and may include a grid heated via either cartridge or band heater. A plurality of heat elements may be employed throughout the tank to optimize melt down and molten feed rates. The heaters may be positioned in such a way to provide heat to both the adhesive in the hot melt tank as well as the pump mechanism. Alternatively separate sets of heating elements may be used to provide heat to the adhesive in the hot melt tank and to adhesive in the pump mechanism. Heating elements will be thermostatically controlled and will comprise circuitry for providing electrical power. The system of the invention comprises a melt tank with heating elements and control capable of reaching maximum operating temperatures of 290° F.

The melt tank is connected to a dispensing pump through a one way check valve which allows material into the molten chamber of the pump (on the piston's return stroke) while restricting reverse flow when under pressure from the pump (e.g., due to forward pumping stroke of piston). Dispensing may also be accomplished via a gear pump, for example.

The invention provides a closed system for automatically processing and dispensing low application temperature hot melt adhesives wherein the adhesive level in the melt tank will be maintained at a predetermined level adhesive level using an auto feed device and level sensor. The closed system prevents contamination and helps to keep work areas safe and clean. Use of a low application temperature adhesive unexpectedly prolongs the life of consumable parts such as nozzles, filters and modules, and decreases wear observed in hoses, pneumatic assembly, vibrator, feeder pneumatic assembly as well as control card, power card, thermostat, RTD, level sensor control board are preferred.

The invention will be described further in the following examples, which are included for purposes of illustration and is not intended, in any way, to be limiting of the scope of the invention.

EXAMPLE

Two hot melt dispensing systems were set up. One, designated the 350° F. unit, was used to process a conventional industrial (350° F.) hot melt adhesive having a viscosity of 800-1200 cps at its at application temperature. The other, designated the 200° F. unit, was used to process a low application temperature (200° F.) hot melt adhesive having a viscosity of 1200-1400 cps at its application temperature.

Each system pumped adhesive through a hose connected to a block containing four different module types (A-D), i.e., four different types of valves use in hot melt dispending equipment, which were directed back into the tank and monitored for signs of failure.

Results are summarized in Table 1, where failure level 1 denotes signs of modules 'dripping' or moderate discontinuous adhesive leakage due to partial seal failure. Failure level 2 represents continuous adhesive flow leakage due to catastrophic seal failure.

TABLE 1

| Failure level | Module type | 350° F. cycles (millions) | 200° F. cycles (millions) | % Improvement |
|---|---|---|---|---|
| 1 | A | 32 | 42 | 31% |
| | B | 32 | 45 | 38% |
| | C | 42 | 54 | 29% |
| | D | 30 | 89 | 199% |
| 2 | A | 38 | 45 | 16% |
| | B | 40 | 58 | 46% |
| | C | 45 | 69 | 55% |
| | D | 37 | 104 | 179% |

As can be seen, all four module types showed extended life when using a low application temperature adhesive.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

The invention claimed is:

1. An integrated system for the processing of low application temperature hot melt adhesives comprising:

(a) a low application temperature hot melt adhesive selected from the group consisting of ethylene/vinyl acetate copolymer, ethylene n-butyl acrylate, isotactic polypropylene, atactic polypropylene, styrene-isoprene, styrene-ethylene-butylene block copolymer and mixtures thereof;

(b) a melt tank having a interior cavity adapted to receive said adhesive, wherein the melt tank comprises a heating means and is connected to a dispensing pump;

(c) an auto feed device integrally connected to the melt tank; and (d) a hose connected to the melt tank, and the hose is a transporting means for said adhesive onto a substrate surface;

wherein the hot melt adhesive is automatically fed by the auto feed device into the melt tank; and wherein the melt tank comprises heating elements that are controlled to reach a maximum operating temperature of 250° F.

2. The system of claim 1 wherein the system is programmed to operate at temperatures of about 225° F. or lower.

3. The system of claim 1 comprising (1) a feed tank for maintaining a supply of said adhesive in its solid form, (2) a supply passage connected to said feed tank for supplying said adhesive to the interior cavity of said melt tank, (3) a supply port in communication with the interior cavity of the melt tank and connected to the supply passage, (4) a nozzle mounting port including a dispensing orifice which is opened and closed by a valve, and (5) a heated transport hose and a nozzle for dispensing said adhesive in its molten form from the dispensing orifice.

4. The system of claim 1 wherein the dispensing pump is a piston pump.

5. The apparatus system of claim 1 wherein the dispensing pump is a gear pump.

6. The system of claim 1 comprising an adhesive inlet valve for introducing solid adhesive into the auto feed device.

7. The system of claim 1 comprising a means for automatically maintaining adhesive level.

8. The system of claim 1 wherein the low application temperature hot melt adhesive comprises ethylene/vinyl acetate copolymer, ethylene n-butyl acrylate, isotactic polypropylene, atactic polypropylene, styrene-isoprene, styrene-ethylene-butylene block copolymer and mixtures thereof.

9. The system of claim 8 wherein the low application temperature hot melt adhesive further comprises a tackifying resin, oil plasticizer, wax and/or additives.

10. The system of claim 9 wherein the additives include stabilizers, anti-oxidant and/or pigments.

* * * * *